US005707592A

United States Patent [19]

Someus

[11] Patent Number: 5,707,592

[45] Date of Patent: Jan. 13, 1998

[54] METHOD AND APPARATUS FOR TREATMENT OF WASTE MATERIALS INCLUDING NUCLEAR CONTAMINATED MATERIALS

[76] Inventor: Edward Someus, Mikszath 81, H-1046 Budapest, Hungary

[21] Appl. No.: 538,502

[22] Filed: Sep. 29, 1995

Related U.S. Application Data

[60] Division of Ser. No. 477,086, Jun. 7, 1995, which is a continuation-in-part of Ser. No. 30,244, filed as PCT/HU92/00029, Jul. 16, 1992, abandoned.

[30] Foreign Application Priority Data

Jul. 18, 1991 [HU] Hungary ..... 17383

[51] Int. Cl.[6] ..... G21C 1/00; C10B 21/00; C10B 1/06

[52] U.S. Cl. ..... 422/159; 422/159; 422/258; 422/269; 422/273; 202/218; 202/136; 202/100

[58] Field of Search ..... 422/159, 269, 422/258, 273; 202/218, 136, 100

[56] References Cited

U.S. PATENT DOCUMENTS

| | | | |
|---|---|---|---|
| 3,938,965 | 2/1976 | Pyle | 44/1 |
| 4,058,205 | 11/1977 | Reed, Jr. | 202/86 |
| 4,079,120 | 3/1978 | Cole et al. | 423/261 |

(List continued on next page.)

FOREIGN PATENT DOCUMENTS

| | | |
|---|---|---|
| 0022214 | 1/1981 | European Pat. Off. . |
| 0025100 | 3/1981 | European Pat. Off. . |
| 0031609 | 7/1981 | European Pat. Off. . |
| 0062337 | 10/1982 | European Pat. Off. . |
| 0070040 | 1/1983 | European Pat. Off. . |
| 0111081 | 6/1984 | European Pat. Off. . |
| 0118058 | 9/1984 | European Pat. Off. . |
| 0126407 | 11/1984 | European Pat. Off. . |
| 0146117 | 6/1985 | European Pat. Off. . |
| 0149798 | 7/1985 | European Pat. Off. . |
| 0204354 | 12/1986 | European Pat. Off. . |
| 0208881 | 1/1987 | European Pat. Off. . |
| 0221679 | 5/1987 | European Pat. Off. . |
| 0237689 | 9/1987 | European Pat. Off. . |
| 0262291 | 4/1988 | European Pat. Off. . |
| 0276775 | 8/1988 | European Pat. Off. . |
| 0278379 | 8/1988 | European Pat. Off. . |
| 0297424 | 1/1989 | European Pat. Off. . |
| 0305847 | 3/1989 | European Pat. Off. . |
| 0307306 | 3/1989 | European Pat. Off. . |
| 0308669 | 3/1989 | European Pat. Off. . |
| 0312742 | 4/1989 | European Pat. Off. . |
| 0330757 | 9/1989 | European Pat. Off. . |
| 0343471 | 11/1989 | European Pat. Off. . |
| 0357939 | 3/1990 | European Pat. Off. . |
| 0358431 | 3/1990 | European Pat. Off. . |
| 0360052 | 3/1990 | European Pat. Off. . |

(List continued on next page.)

*Primary Examiner*—Nina Bhat
*Attorney, Agent, or Firm*—Ladas & Parry

[57] ABSTRACT

A method and apparatus for the treatment of waste materials including nuclear contaminated materials is disclosed. The method of the invention includes the steps of: grinding the base material until the maximum grain size is 50 millimeters; drying the ground material to a relative humidity content below 30%; distilling the material at a core temperature of 100°–1200° C. on a negative pressure from 200 $N/m^2$ to an over pressure of 300 $kN/m^2$ in an oxygen free, reducing, indirect heated environment; burning or cooling the vapors arising; treating the remaining solid materials by combustion, mineralization, vitrification, or solidification; and pelletizing or granulating the remaining ash. The apparatus of the invention includes a dry distillation reactor that has a rotary, closed, horizontally arranged cylinder with hollow axes on the ends. The axes are separated from input and output houses by seals. The input house is provided with a loading opening and a gas exit branch. The output house is provided with an unloading opening and a gas exit branch. The ends are sealed by sealing segments placed on the axes and sealing rings placed between the sealing segments and the walls of the input and output house.

3 Claims, 4 Drawing Sheets

U.S. PATENT DOCUMENTS

| | | | |
|---|---|---|---|
| 4,129,420 | 12/1978 | Koppelman | 44/51 |
| 4,156,394 | 5/1979 | Mallek et al. | 110/346 |
| 4,176,010 | 11/1979 | Dudek | 201/27 |
| 4,217,175 | 8/1980 | Reilly | 202/118 |
| 4,218,288 | 8/1980 | Theodore | 201/12 |
| 4,229,317 | 10/1980 | Babad et al. | 252/301 |
| 4,230,675 | 10/1980 | Yarbro | 422/272 |
| 4,235,739 | 11/1980 | Baatz et al. | 252/301.1 W |
| 4,280,879 | 7/1981 | Taciuk | 202/100 |
| 4,308,103 | 12/1981 | Rotter | 202/117 |
| 4,316,876 | 2/1982 | Mills et al. | 422/151 |
| 4,318,713 | 3/1982 | Lee et al. | 48/203 |
| 4,366,026 | 12/1982 | Leyendecher | 201/1 |
| 4,459,201 | 7/1984 | Eakman et al. | 208/11 |
| 4,477,257 | 10/1984 | Koppelman et al. | 44/30 |
| 4,479,869 | 10/1984 | Petterson et al. | 208/130 |
| 4,521,379 | 6/1985 | Beane | 422/209 |
| 4,533,438 | 8/1985 | Michel et al. | 201/31 |
| 4,555,361 | 11/1985 | Buckley et al. | 252/626 |
| 4,560,501 | 12/1985 | Minami et al. | 252/628 |
| 4,563,246 | 1/1986 | Reed et al. | 202/100 |
| 4,565,670 | 1/1986 | Miyazaki et al. | 422/186.04 |
| 4,591,362 | 5/1986 | Yudovich et al. | 48/197 |
| 4,618,736 | 10/1986 | Bennet et al. | 588/240 |
| 4,794,871 | 1/1989 | Schmidt et al. | 110/341 |
| 4,797,091 | 1/1989 | Nuemann | 432/14 |
| 4,840,129 | 6/1989 | Jelinek | 110/229 |
| 4,840,765 | 6/1989 | Doherty et al. | 376/310 |
| 4,977,839 | 12/1990 | Fochtman et al. | 110/346 |
| 4,985,131 | 1/1991 | Lane | 208/609 |
| 5,078,593 | 1/1992 | Schreiber et al. | 432/103 |
| 5,086,716 | 2/1992 | Lafser, Jr. | 110/345 |
| 5,096,463 | 3/1992 | Beiere et al. | 48/76 |
| 5,101,740 | 4/1992 | Abvil | 110/230 |
| 5,178,828 | 1/1993 | Uesugi | 422/22 |
| 5,181,990 | 1/1993 | Arisaki et al. | 196/110 |
| 5,185,104 | 2/1993 | Horie | 252/632 |
| 5,188,649 | 2/1993 | Macedo | 65/21.3 |
| 5,194,069 | 3/1993 | Someus | 44/500 |
| 5,261,936 | 11/1993 | Someus | 55/222 |
| 5,278,379 | 1/1994 | Takanashi | 219/679 |

FOREIGN PATENT DOCUMENTS

| | | |
|---|---|---|
| 0446930 | 9/1991 | European Pat. Off. . |
| 2569297 | 2/1986 | France . |
| 2649692 | 1/1991 | France . |
| 3049285 | 12/1981 | Germany . |
| 3442506 | 5/1986 | Germany . |
| 3742235 | 7/1988 | Germany . |
| 3844700 | 11/1990 | Germany . |
| 405223986 | 9/1993 | Japan . |
| 0340280 | 2/1978 | U.S.S.R. . |
| 1222123 | 2/1988 | U.S.S.R. . |
| 1446139 | 12/1988 | U.S.S.R. . |
| 1444564 | 8/1976 | United Kingdom . |
| 8301781 | 5/1983 | WIPO . |
| 8701124 | 2/1987 | WIPO . |

METHOD AND APPARATUS FOR TREATMENT OF WASTE MATERIALS INCLUDING NUCLEAR CONTAMINATED MATERIALS

This is a divisional of co-pending application Ser. No. 08/477,086 filed on Jun. 7, 1995, which is a continuation-in-part of application Ser. No. 08/030,244 filed as PCT/HU92/00029, Jul. 16, 1992, now abandoned.

FIELD OF THE INVENTION

The method of the present invention relates to the treatment of waste materials including nuclear contaminated materials, commonly known as radioactive waste, and set out from ground base material purified from metal waste. The invention also relates to an apparatus for the treatment of waste materials including nuclear contaminated materials, i.e. radioactive wastes.

Specifically, the invention relates to an apparatus that includes a reactor provided with a rotary, closed, indirectly heated, horizontally arranged cylinder with hollow axes placed on both ends of the cylinder. The axes are supported with roller bearings which can provide rotating movement of the cylinder. One end of the axes terminates into an input house while the other terminates into an output house. The axes are separated from the output and input houses by seals and an input pulley which is built-in into the hollow of the sideways axis of the input house.

DESCRIPTION OF THE RELATED ART

Because of the existence of environmental protection regulations, there is a frequent need for the treatment of waste materials. Depending on the waste treatment method selected, it may be possible to eliminate or decrease the damaging environmental effects of the waste materials. The quantity of the environmentally damaging component may also be decreased in the waste material.

Often, hazardous waste materials are kept well isolated from the environment. Unfortunately, hazardous waste storage is less safe and cost effective than waste treatment as the volume of the environmentally damaging toxic substances is higher, the construction cost of facilities with proper environmental isolation is extremely high, and the required storage time period may be very long. For example, nuclear environmental pollutants should theoretically be kept in storage until the radiation falls below the permitted limit.

The most elementary waste treatment procedure known involves compressing the waste material or contaminated material, thereby decreasing the final volume to be stored. The disadvantage of this procedure is that the mass and hazardous character, often water soluble, of the processed material are not decreased at all, resulting in a very low efficiency.

In the course of another waste treatment procedure, waste materials including nuclear contaminated material are treated thermally. The material is gasified in a partly reductive environment with direct heat transfer and successively burned. The disadvantage of this method resides in the fact that the quantity of highly contaminated corrosive gas and the water soluble ash with hazardous residue character resulting from this burning procedure are superfluously high. The disadvantage of the different apparatus used in this procedure is that the sealings between the rotary and stationary part provide large diameter and are semi-open construction. Deficiencies in the mechanical engineering aspects of the apparatus obstruct high energy heat transfer and result in lower destruction removal efficiency during the heat transfer process. In the partially oxidative or oxidative environment, large volumes of complex hazardous gases are formed. Any variation in input waste flow results in variation of output gas flow and therefore, an uncontrollable process. The oxidative environment provides resultant water soluble solid residues with hazardous waste character. Examples of such processes, commonly known as pyrolysis techniques, are disclosed in the following documents.

U.S. patent application Ser. No. 878,088 (Title: Method and Apparatus for Removing Hydrocarbons from Discarded Tires by Pyrolysis) describes an indirectly heated rotary kiln apparatus having a screw type conveyor.

German Patent DE 3307737 (Mar. 4, 1983, Title: Verfahren und Vorrichtung zur Vernichtung von Flussigen Oder Pastenformigen Abfallstoffen) describes a known technique rotary kiln with a variation of external heating installation at the middle of the rotary kiln.

German Patent DE 3520440 (Jun. 7, 1985, Title: Pyrolysenanlage) describes a directly heated rotary kiln pyrolysis apparatus operating in an oxidative environment.

U.S. Pat. No. 4,555,361 (Nov. 26, 1985, Title: Method of Reducing the Volume of Solid Radioactive Waste) described a method using pyrohydrolysis and gasification characterized by standing retort installation.

U.S. Pat. No. 4,840,129 (Jun. 20, 1989, Title: Pyrolysis System) describes a directly heated pyrolysis system using cracked gases for heat up.

The known methods and apparatus are different combinations of directly or indirectly heated drying apparatus, directly heated gasification type apparatus, and gas treating apparatus. Therefore, the known apparatus do not yield treated waste materials with the lowest possible mass and volume. The known apparatus also require the introduction of an unnecessarily high volume of air which becomes contaminated during the process. Furthermore, the known apparatus do not allow for continuous operation and control of the procedure.

A specific technical implementation of the known pyrolysis methods and apparatus has a vertically mounted container which makes loading of the material, closing and heating of the distillator, and performing the dry distillation process with intermittent running possible. However, when the retained solid material is removed from the reactor after pyrolysis, harmful gases are emitted to the environment in an uncontrollable way.

Another known apparatus has a rotatable horizontal cylinder or cylinder with an inclination. However, this apparatus exhibits less than optimum heat transfer, sealing, and gas treatment when under heavy loading for an extended time.

Therefore, the waste treatment apparatus in the prior art are open or semi-open and the treatment processes and the resulting process products cannot be controlled efficiently. There is a need in the art for a waste treatment apparatus with a horizontal cylinder that utilizes continuous heating and can load and unload solid materials in a closed system. The apparatus must also withstand extreme use and high loads.

SUMMARY OF THE INVENTION

Accordingly, the present invention provides a method for the treatment of waste materials including the steps of:

grinding the waste materials to a grain size under 50 millimeters;

drying the waste materials to a relative humidity below 30%;

dry distilling the waste materials at a core temperature of 100° C. to 1200° C. between the negative pressure range from 200 $N/M^2$ to over pressure of 300 $kN/M^2$ in an oxygen free reducing environment;

condensing the vapors resulting from the drying;

treating the vapors resulting from dry distillation by burning or cooling; and treating the waste material remaining from the dry distillation by combustion, mineralization, vitrification, or solidification.

The remaining waste material may be further treated to remove environmentally hazardous or radioactive materials. The remaining waste material may also be activated prior to cooling by the addition of various reactants. Advantageously, calcium or sodium compounds are mixed into the ground base material and the concentration parameters of the waste materials are continually monitored and controlled. The volume of the solid end products may also be reduced by pelletization or granulation.

The invention also includes an apparatus for carrying out the method of the invention.

BRIEF DESCRIPTION OF THE DRAWINGS

The present invention will now be described by way of example and with reference to the appended drawings, in which.

DESCRIPTION OF THE INVENTION

Figure 1:
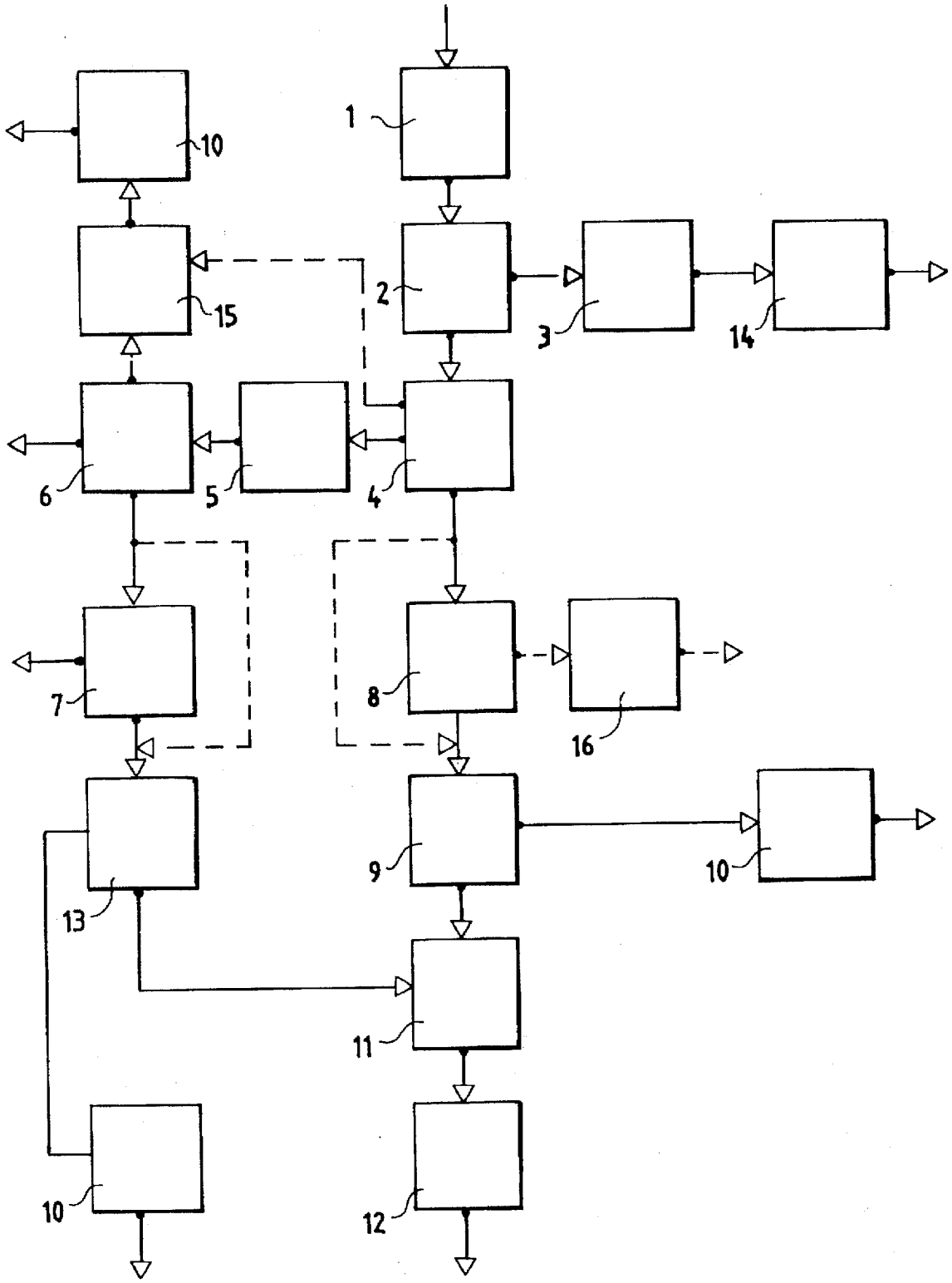
FIG. 1 is a schematic view of an exemplary apparatus according to the invention.
Figure 2:
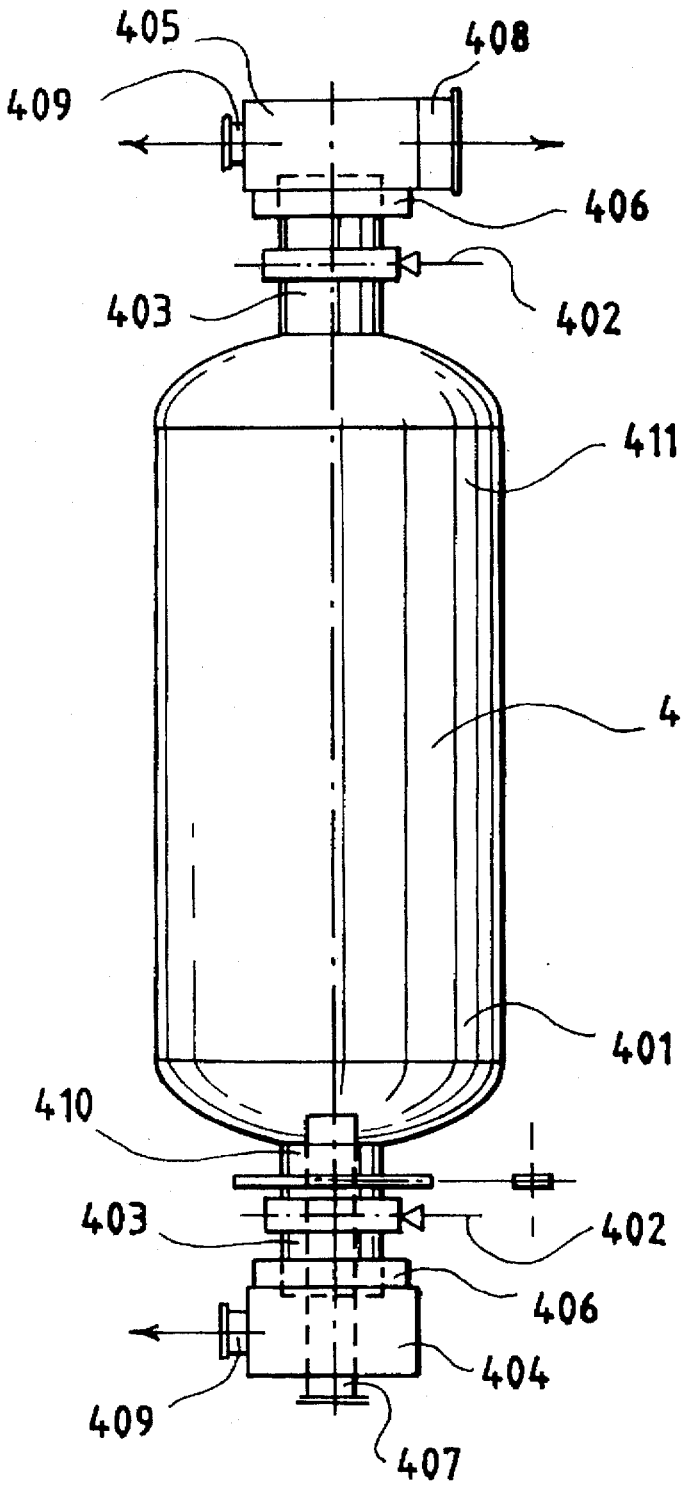
FIG. 2 is a side view of the dry distillation reactor of the apparatus of the invention.
Figure 3:
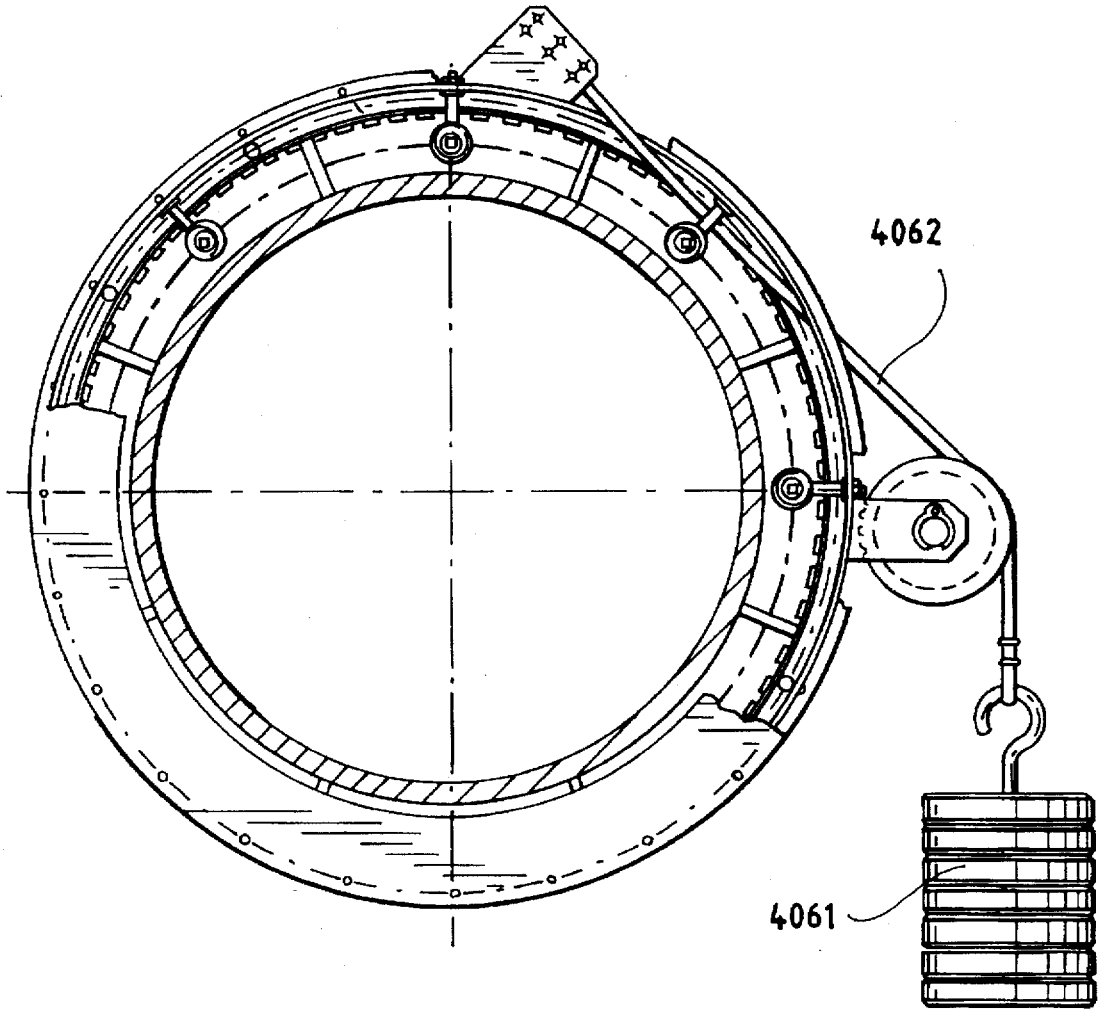
FIG. 3 is a front view of the dry distillation reactor of the apparatus of the invention.
Figure 4:
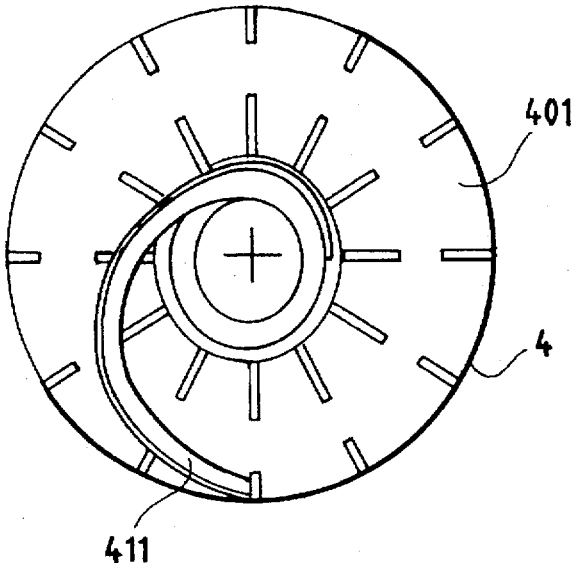
FIG. 4 is a section view of the dry distillation reactor of the apparatus.

The method of the present invention treats waste materials so that the contained hazardous materials, such as organic compounds, heavy metals, halogenated compounds, and radioactive materials, are concentrated in the smallest possible mass and volume. The method also conditions the mixed complex toxic input substances into non-hazardous, i.e., water insoluble, output substances. Even if the basic material is of organic, inorganic, or mixed character, the chemical components will be separated at a certain treatment temperature if the boiling point of the components are under the treatment temperature. The pyrolysis reactions are not only a sequenced series of reactions, but a parallel series of reactions as well, with different activities of energy. By control of heating and residence time, a very wide range of input products can be treated with mixed chemical composition.

The method of the present invention is based on the discovery that the contaminated input materials, which have inhomogeneous chemical and physical composition, different thermal conductivities, and extreme variation in characteristics under thermal treatment and flow, can be decomposed into components of different contamination grades. By combining different chemical and physical processes corresponding to the characteristics of the toxic components involved, the lowest possible value of contaminated mass and volume of the end products can be reached. The mass and volume of the end products and the volume of dangerous gas produced during the process is significantly less than that of the methods known in the prior art.

The method of the present invention includes the steps of grinding the waste materials, drying the waste materials, dry distilling the waste materials, and treating the end products of the process. Many variations of the waste treatment method are envisioned; the following description of each of the steps of the method addresses some of the variants.

Organic and inorganic materials that are suitable for dry distillation are used as the starting materials. These materials are ground until a maximum grain size of 50 millimeters is reached. The maximum grain size facilitates effective waste treatment.

The ground base material is then dried to a relative humidity content below 30%. Any steam leaving the waste material during drying is not usually contaminated; however, when treating nuclear or volatile materials, the steam may contain radioactive or hazardous materials. In this case, the gas should be condensed and the radioactive or hazardous materials should be removed from the condensed water. Depending on the humidity ratio of the ground base materials, the mass of the waste material may be considerably reduced.

After drying, the materials are dry distilled at a core temperature of 300°–1200° C. and between the negative pressure range from 200 $N/M^2$ to over pressure of 300 $kN/m^2$. The distillation operates typically from 0 to 50 $N/m^2$ negative pressure, i.e., vacuum, under the atmospheric pressure in an oxygen-free reducing environment with indirect heating.

During the heating up portion of the distillation process, the volatile compounds are broken down into smaller molecules. The pyrolysis products are generally not similar to the chemical composition of the basic material, but are new chemical components. The steps of the pyrolysis process are thermal inductions of the material. Depending on the chemical composition of the waste material, different quality and quantity of pyrolysis gas vapors and residual solid materials are produced. If the basic material is of organic origin, the solid end product is carbon containing ash and combustible gas vapors.

During the thermal decomposition, primary and secondary products are produced. The primary products are the out-gassed pyrolysis gas vapors and solid end products. The secondary products are the tarry materials or the incompletely desorbed inorganic components. To minimize the production of secondary products, the dry distillation is processed in a vacuum to let the pyrolysis gas vapors leave the reaction space as soon as possible. This action promotes the diffusion of the pyrolysis gas vapors from the core of the material up to the surface. The low partial pressure of the volatile compounds gives the reaction balance a permanent tendency in the direction of the production of primary products.

During the dry distillation, all of the volatile and evaporable organic and inorganic substances will be removed. Due to the high temperature of the dry distillation and the effect of thermal shock, the material decomposes during the process. Experience has shown that depending on the composition of the starting material, the significant part of the toxic and radioactive substances will be concentrated either in the pyrolysis gas vapor phase or in the solid phase. The separated phase concentration is governed by the boiling point, treatment time, and chemical composition characteristics of the toxic substances.

For instance, the length of time between a nuclear contamination and waste treatment using the present methods affects the separated phase concentration. In radioactive materials treated a short time after nuclear contamination, most of the radiating materials, due to the large quantity of radioactive iodine, concentrate first in the gas phase. If a longer time has passed between the contamination and the treatment, the majority of the decomposed nuclear contamination concentrates in the remained solid phase.

The pyrolysis gas vapors arising from the dry distillation should be directly burned or tempered for a controlled period of time at high temperatures, depending on the corresponding hazardous material content. Because the combustible volatile materials originating during the procedure are burned the method is very economical from the viewpoint of energy. Hazardous gases should be precipitated with a cooling down below 60° C. The resulting liquid can be processed further and the remaining combustible gases can be burned. The remaining combustible gases may also be further precipitated or purified by washing them in a liquid phase. Bubbling or buffering the gases in liquids also decreases the energy content.

As a result of treating the pyrolysis gas vapors, flue gas will arise from the gas phase or will be decomposed to condensed complex tars or pyrolysis oils. During the pyrolysis gas vapor treatment step, the flue gases or non-condensable gases produced are generally non-hazardous. Therefore, it is advantageous to burn them. In the case of nuclear contaminates, the radiating materials should be removed from the combustion products by known methods.

The solid material remaining after dry distillation may be processed in a variety of steps. The materials may be cooled in an oxygen free environment to room temperature. Advantageously, the tar and solid materials should be burned for maximum mass and volume reduction. For the sake of environmental protection, the process should strive for perfect burning. Even though the burning produces purified, separated materials, the resulting gases may contain a small amount of contaminating materials. In the case of nuclear materials, the arising flue gases should be decontaminated by known methods.

If the solid material remaining after dry distillation is of inorganic character, the material may be mineralized or vitrified at high temperature to enclose the harmful components, stabilize the end product, and make the material water and time resistant. Typically, mineralization or vitrification is undertaken in a direct heated system over 1000° C. The solid material may also be stabilized by mixing with warm bitumen or cement at atmospheric conditions to form a water insoluble, stabilized end product suitable for long term disposal.

If the solid material remaining after dry distillation is of pure activated carbon character, the material is post activated before cooling by adding a reactant such as carbon dioxide, nitrogen, steam, a noble gas, or other chemical activating agent or mixture of agents.

The solid end products may also be conditioned by granulation or pelletization. The high boiling point hazardous materials in the starting material, i.e., the radionuclides, heavy metals, and inorganics, will be concentrated in the ash or vitrified end product after treatment. Because of the reductive process environment, the radionuclides and heavy metals have a similar tendency to be concentrated in the solid end products in metallic form. Even though the remaining mass is much smaller than the starting mass of the waste material, a significant volume of end products can remain. Advantageously, the volume of the end products can be decreased by pelletizing or granulation. Typically, granulation is undertaken at a pressure of 50 kg/cm$^2$–300 tons/cm$^2$.

The final waste materials can also be stabilized by adding a catalyzer compound containing calcium or sodium or similar element to the granulated base material. By mixing 25 mass % to 125 mass % of calcium or sodium compound additives to the granulated base materials, the instable chemical toxic contaminating substances in the waste material can be transformed to stabilized chemical substances, such as hydroxides.

In summary, the objective of the method of the invention is to concentrate dangerous materials, such as radiating hazards and heavy metals, in the ash, mineralized or vitrified end product, or bitumen/cement solidified end product. This will minimize the extent of dangerous materials emitted during the final storage. Also, the hazardous content of the arising gases can be continuously cleansed and measured and the process controlled so that a minimum quantity of dangerous materials goes into the outcoming gases. Any hazardous substances remaining in the flue gases or liquids should be removed before emission to the environment. Advantageously, the radiation and chemical parameters of all flue gases and liquids are continuously measured and the processes are controlled in such a manner that the radiation and chemical loading of the filters is as low as possible.

The following Examples demonstrate the effects of the method of the invention. However, the invention is not to be construed as being limited to these examples for there are numerous possible variations and modifications.

EXAMPLE NO. 1

Basic Material: Nuclear contaminated waste of oak and acacia wood

Date of the Experiment: February, 1991

Place of the living tree: at a distance of approx. 1000 km from Chernobil

Starting quantity: One ton

Starting Volume: 3.4 m$^3$

Basic material, moisture content: 42 mass %

Basic material, background radiation: 37 kiloBecquerel (1 microCurie)

The basic material was cut into grain sizes of 0.1–6 mm. Previous indirect drying was performed with 400 degree Celsius flue gas, down to 8 mass % humidity. Dry distillation was processed with a duration time of 16 minutes on 600 degree Celsius, with 30 N/m$^2$ depressive pression under atmospheric pressure.

Measured results:

Complex mass after drying: 660 kg

Mass of solid material after distillation: 197 kg

Mass of complex tar phase: 463 kg

The radioactivity analysis of samples was done with neutron activation analysis and the following results were obtained. Measurements were made with three different samples of tars and with carbon samples originating from two different series.

| Sample | Tar | | Tar | | Tar | | Carbon | | Carbon | |
|---|---|---|---|---|---|---|---|---|---|---|
| Radio-nuclide | Curie kg | Bq kg | Curie kg | Bq kg | Curie kg | Bq kg | Curie kg | Bq kg | Curie kg | Bq kg |
| 40 K | $4.6 * 10^{-9}$ | $1.7 * 10^{2}$ | $<3.3 * 10^{-9}$ | 122 | $<3.7 * 10^{-9}$ | <137 | $<1.1 * 10^{-7}$ | $4.1 * 10^{3}$ | $8.1 * 10^{-9}$ | $3.0 * 10^{2}$ |
| 60 Co | $8.4 * 10^{-10}$ | $3.1 * 10^{1}$ | $6.6 * 10^{-10}$ | 24 | $3.9 * 10^{-10}$ | 14 | $2.1 * 10^{-8}$ | $7.7 * 10^{2}$ | $1.4 * 10^{-8}$ | $5.2 * 10^{2}$ |
| 106 Ru | $9.0 * 10^{-9}$ | $3.3 * 10^{2}$ | $9.5 * 10^{-9}$ | 265 | $9.7 * 10^{-9}$ | 359 | $3.0 * 10^{-8}$ | $1.11 * 10^{3}$ | $8.0 * 10^{-8}$ | $3.0 * 10^{2}$ |
| 100 mAg | $<1.9 * 10^{-10}$ | <7.0 | $<1.7 * 10^{-10}$ | <6 | $1.7 * 10^{-10}$ | <6.5 | $2.7 * 10^{-8}$ | $1.0 * 10^{3}$ | $3.4 * 10^{-9}$ | $1.3 * 10^{2}$ |
| 125 Sb | $1.5 * 10^{-9}$ | $5.5 * 10^{1}$ | $2.6 * 10^{-10}$ | <10 | $2.0 * 10^{-9}$ | <8 | $<1.2 * 10^{-8}$ | $4.4 * 10^{2}$ | $<7.0 * 10^{-9}$ | $2.6 * 10^{2}$ |
| 134 Cs | $9.5 * 10^{-10}$ | $3.5 * 10^{1}$ | $6.2 * 10^{-10}$ | 23 | $7.4 * 10^{-9}$ | 270 | $3.3 * 10^{-8}$ | $1.22 * 10^{3}$ | $9.7 * 10^{-9}$ | $<3.6 * 10^{2}$ |
| 137 Cs | $1.1 * 10^{-9}$ | $4.1 * 10^{1}$ | $1.2 * 10^{-9}$ | 44 | $4.1 * 10^{-10}$ | 15 | $2.6 * 10^{-8}$ | $9.6 * 10^{2}$ | $7.0 * 10^{-9}$ | $2.6 * 10^{2}$ |
| 154 Eu | $<2.0 * 10^{-10}$ | <7.0 | $1.8 * 10^{-10}$ | 6.7 | $2.0 * 10^{-10}$ | 7 | $<3.3 * 10^{-9}$ | $<1.2 * 10^{2}$ | $1.0 * 10^{-8}$ | $3.7 * 10^{2}$ |
| 212 Bi | $<6.2 * 10^{-10}$ | $<2.3 * 10^{1}$ | $<7.1 * 10^{-10}$ | 26 | $<1.0 * 10^{-9}$ | 37 | $3.2 * 10^{-8}$ | $1.18 * 10^{3}$ | $<1.0 * 10^{-8}$ | $<3.7 * 10^{2}$ |
| 214 Bi | $<3.4 * 10^{-10}$ | $<1.3 * 10^{1}$ | $7.3 * 10^{-10}$ | 27 | $9.5 * 10^{-10}$ | 35 | $<1.1 * 10^{-8}$ | $<4.1 * 10^{2}$ | $<6.0 * 10^{-9}$ | $<2.2 * 10^{2}$ |
| 214 Pb | $<4.9 * 10^{-10}$ | $<1.8 * 10^{1}$ | $<4.5 * 10^{-10}$ | 17 | $5.2 * 10^{-10}$ | 19 | $<1.7 * 10^{-8}$ | $<6.3 * 10^{2}$ | $<9.7 * 10^{-9}$ | $3.6 * 10^{2}$ |
| 226 Ra | $6.0 * 10^{-9}$ | $<1.7 * 10^{2}$ | $<5.3 * 10^{-9}$ | $1.9 * 10^{2}$ | $6.3 * 10^{-7}$ | $<2.3 * 10^{4}$ | $<2.8 * 10^{-5}$ | $<1.04 * 10^{6}$ | — | — |
| 228 Ac | $1.5 * 10^{-9}$ | $5.6 * 10^{1}$ | $<4.0 * 10^{-10}$ | 15 | $1.3 * 10^{-11}$ | 0.5 | $<1.6 * 10^{-8}$ | $<5.9 * 10^{2}$ | $<8.7 * 10^{-9}$ | $<3.2 * 10^{2}$ |

The solid material and tar that remained after condensation were burned with an oxygen-air mixture. After combustion, 13.79 kg of ash remained from the solid material, and 18.52 kg of ash from the tar. To the rest of the ash, 5 mass % proportion wet concrete was mixed as binding material and the mixture that originated was pelleted. After pelleting, the volume of the material was 0.016 $m^3$, which means that the volume of the dangerous waste for final storage was only 0.47% of the volume of the starting wood waste.

EXAMPLE NO. 2

The experiment was performed with a mixed waste material containing heavy metals (mercury luminescent lamp tubes, light sources, plastic waste materials containing heavy metals) at 600 and 800 degrees Celsius nucleus temperature with 1 t/h capacity. The experiment was performed to investigate the final temperature of pyrolysis, to state how different heavy metal containing materials in what form can be made treatable with a proper concentration in a suitable phase, and to test the mineralization/vitrification process.

During the experiment, it was stated that by increasing the temperature, the amount of remaining solid material decreases. The volume of liquid products depends on the composition and the character of the basic material, but it can be generally stated that it reaches a maximum value at about 600 degrees Celsius. The majority of the heavy metal content concentrated in the remaining solid materials, which was expected according to the original calculations; however, mercury and cadmium, due to their character, appeared first of all in the gas phase which was purified. Further treatment of the remaining organic solid material was done with the combustion of the material, and the final product, being unsuitable for further treatment, was set after briquetting for final storage. The carbon content of the remaining waste material pyrolysed at 800 degrees Celsius was 15.4%. In the final stage, the solid remaining materials were vitrified at 1400 degrees Celsius, which resulted in the heavy metals being included in the molten material and the water-cooled solid end product.

Comparison of the heavy metal content of the starting base material and the remaining solid material in mass %:

| | Starting Base Material | Remaining Solid Material |
|---|---|---|
| Cadmium | 0.007 | 0.003 |
| Chrome | 0.56 | 0.65 |

-continued

| | Starting Base Material | Remaining Solid Material |
|---|---|---|
| Barium | 16.5 | 21.1 |
| Lead | 0.27 | 0.33 |
| Mercury | 0.5 | 0.005 |
| Zinc | 5.1 | 6.4 |

EXAMPLE NO. 3

The experiment related to the treatment of an unsorted mixture of PVC, polyethylene, polyurethane plastic material, and rubber wastes with additives, which changed the organic chemical bonds of the basic material to inorganic chemical bonds through mineralization processes.

The procedure resulted in the neutralization of the hazardous character of the waste material. Laboratory analyses proved that cadmium was applied as a pigment and stabilizer material for the plastic waste material, while the basic material was contaminated with chrome at the same time.

Starting basic material masses:

| | | | |
|---|---|---|---|
| PVC | 260 kg | Polyurethane | 35 kg |
| Polyethylene | 205 kg | Additives | 500 kg |
| Total | 1000 kg | | |

Fine ground, 0–3 mm grain structured CaO additive was mixed into complex, unclassified, 0–3 mm ground plastic waste material in equal quantities and heated evenly to a core temperature of 780° Celsius for 35 minutes and kept on 780° Celsius for 15 minutes. Meanwhile, the additive and the waste material volatile chemically reacted under mechanical stirring and as the solid phase separated from the gaseous phase, a cooling was performed for further purification and final utilization. The mixture of the material started to decompose immediately over 200° Celsius temperature, and as a result of the increased temperature, the following final product was received:

| | |
|---|---|
| Mineralized $CaCl_2$, $CaCrO_4$ (calcium chloride, calcium chromate) | 440 kg |
| Pyrolysis gas | 270 kg |
| CaO carbon settling | 290 kg |

Characteristic of all three final products was that the cadmium contamination was present to a different extent, while chrome appeared in the solid phase. Due to the character of the cadmium at this pyrolysis temperature, cadmium primarily concentrated in the gaseous phase, but also remained in traces in the solid phase. After burning the combustible gas phase, cadmium concentrated in the remaining ash and on the filter. The carbon settling on CaO was burned; thus the settled 180 kg carbon quantity appearing in the form of ash was in excess of 110 kg CaO.

With the combustion of the pyrolysis gas, a significant amount of energy was received as the energy content exceeded 5500 Kcal/Nm$^3$. Gaseous materials received from the combustion of both the solid and gaseous phase materials were purified and filtered by known methods which yielded materials corresponding to the environmental prescriptions for permitted emission in the open air or other inorganic materials to be combined with other compounds.

Successful studies have been made concerning the treatment of primary health care waste and pharmaceutical waste, PCB contaminated soil, high moisture content nuclear contaminated sludge from radioactive water treatment, solid industrial hazardous waste, desulphurization of coal and lignite, and municipal solid waste.

It has been stated that the multi-phase treatment method is more advantageous in the case of hazardous waste materials, since less gaseous and solid material are to be treated and these are chemically decomposed, homogeneous, and treatable. Further, the purification and treatment of the remaining materials are simpler. Treatment with other additives, such as $CaCO_3$ (calcium carbonate) is also advantageous.

In FIG. 1, a schematic representation of an exemplary apparatus providing treatment of nuclear or chemical waste material is shown. A grinding device (1) is connected with a drying unit (2). The drying unit (2) is connected with a dry distillery (4) and a condenser (3). The dry distillery (4) is connected to a gas treating unit (5) or a gas combustor (15). The dry distillery (4) is also connected to a cooler (8) which is connected to a solid material combustor or mineralisator or virtificator (9). The gas treating unit (5) is connected with a gas cooler (6). The gas cooler (6) is connected with a liquid combustor (13) and/or the gas combustor (15). The solid material combustor or minerisator or vitrificator (9) and the liquid combustor (13), by way of a solid material cooler (11), are connected with a pelletizer unit (12). The gas combustor (15) is connected to a gas filter (10). The condenser (3) is connected to a condensed liquid treating unit (14). The devices of the scheme are connected to the open environment through gas filter (10), a liquid treating unit (7), a solid material treating unit (16), the pelletizer unit (12), and the condensed liquid treating unit (14).

An advantageous variant of the apparatus provides that the pyrolysis gas vapor phase can be burned directly without cooling by gas combustor (15) and the flue gas can be emitted through the gas filter (10) to the open air. In this case, gas treating unit (5), gas cooler (6), liquid treating unit (7), liquid combustor (13), and the gas filter (10) can be omitted. In another advantageous variant, either or both cooler (8) and liquid treatment unit (7) can be left out.

The connection arrangement of the apparatus yields the following material flows. The starting solid state material is fed to dry distillery (4) through grinding device (1) and drying unit (2). In drying unit (2), a significant part of the steam leaves the solid material. In dry distillery (4), gases and the remaining steam leave the solid material. The remaining solid material enters the solid material combustor or mineralisator or vitrificator (9), either through cooler (8) or directly, and is processed through solid material cooler (11) and/or pelletizer unit (12). If the contamination character of the material permits, the solid material, following the treatment in solid material treating unit (16) can be released to the open environment. Steam from drying unit (2) flows to condenser (3) where it is condensed. The condensed liquid enters the condensed liquid treating unit (14) and is released to the open environment after purification.

The pyrolysis gas vapor phase can be combusted immediately in gas combustor (15) without cooling and the flue gases can be released through gas filter (10) to the open air or utilized. According to another advantageous connection arrangement of the apparatus, gas treating unit (5) and gas cooler (6) form a multi-connected unit in which tar and pyrolysis oils and vapors precipitate. The tarry materials with a relatively high steam content from gas cooler (6) enter the liquid treating unit (7) while non-condensable gases enter the gas combustor (15) where they are burned before purification in gas filter (10) and release to the open environment.

The water containing tar goes from liquid treating unit (7) to liquid combustor (13), where it is burned. The remaining ash is passed to the solid material cooler (11). The carboniferous solid phase proceeds from dry distillery (4), through cooler (8), and into solid material combustor (9) where it is combusted by adding air or oxygen. Combustion gases from solid material combustor (9) and liquid combustor (13) pass through gas filter (10) and into the open environment.

The ash remaining after combustion in the solid material combustor (9) is transferred to solid material cooler (11) for cooling. The cooled ash enters the pelletizer unit (12) where the ash is mixed with an additive such as cement or bitumen. The solidified end product may be pelletized or granulated before the end product is stored as hazardous material. If the character of the contaminated material permits, the purified material in liquid treating unit (7) can be released immediately to the open air. From condensed liquid treating unit (14) and liquid treating unit (7), purified water will enter the receiver.

The combination of features embodied in the dry distillation reactor of the apparatus makes the apparatus suitable for bearing different loads and performing a continuous dry distillation procedure in a closed system without any higher demand for maintenance. The reactor's loading house is provided with a loading opening and a gas phase exit branch. The unloading house is provided with an unloading opening and a gas phase exit branch. Carrying-out shovels are fixed to the inner casing of the reactor cylinder on the side of the output house. The reactor is sealed by sealing segments drawn together by a cord pulled by weights and sealing rings placed between the sealing segments and the loading house and unloading house walls. The sealing rings are secured by holders against radial displacement, while the sealing segments and the sealing rings are secured against axial displacement by a spring clamp unit.

The reactor is horizontally arranged and cylindrically formed with no refractory lining inside. The reactor rotates around its symmetric axle. The high quality steel mantel is heated from outside through a lined combustion chamber. Inside the reactor body, blades promote the transportation of the material. The reactor is a permanently working vessel; the basic material enters at the input end, while the outgassed solid material and the pyrolysis gas vapor phase are separately discharged at the output end. Heat transfer is processed through the mantel and sealing, which is installed on the small diameter of the rotary kiln. The sealing allows for three dimensional movement between the rotary and the stationary part, with chemical and heat resistance character.

The heat transfer contains three phases. First, energy is transferred from heat under the material in the rotary kiln. The ground material with extended surface area is continuously mixed. The mixing process is promoted by blades inside the reactor body. The heated material is continuously replaced by cooler materials. Therefore, the thermal conductivity of the solid waste material is of less importance and can be within a wider range. The second phase of heat transfer is radiation heat transfer from the inner top surface of the reactor body. Third, an exothermic reaction starts during the decomposition of the material over the temperature of 275° C. It is to be noted that the basic pyrolysis process is of endothermic character, which means that heat must be transferred. High water content wastes require a high input of energy during the drying and heating up process. Therefore, a low input moisture content is preferable. Reactions at temperatures over 275° C. become exothermic. In some instances, heat has to be taken away to control the process. Otherwise, overheating cannot be controlled.

The length of the reactor ensures that sufficient time is allowed to complete the heating process during the throughput of the material. The volatile compounds will only perfectly gas-out if the temperature of the thermal treatment through the waste material is higher than the limit temperature of the transformation point.

The size and form of the reactor is such that the gas-out process is different in different sections of the reactor interior, with thermal decomposition running parallel at different sections. The exothermic process tends to be a slow process. Therefore, the extended pyrolysis gas vapor production will not result in an explosive production of pyrolysis gas vapors. Even if a theoretically possible explosive production of pyrolysis gas vapors occurs, the size of the reactor's inner space, the reductive environment, and the adjustable permanent vacuum control compensate the action.

There are five well-distinguished phases of the dry distillation process occurring inside the reactor. First, there is a warm up phase under 160° C. This phase is characterized by the evacuation of the free and most of the bonded water from the material. Second, there is a heating up phase up to 270°–280° C. The second phase is characterized by heavy discoloration of the material and the evacuation of the remaining chemically bonded water, with simultaneous development of gasification. Third, there is a thermal decomposition phase up to 380°–400° C. that is characterized by self-carbonization with exothermic chemical reactions and a heavy gasification process. Fourth, there is a gas-out phase up to 500° C. that is characterized by the escape of volatile compounds, including the heavy tars, from the material. Fifth, there is a stabilization phase over 500° C. The conversion and decomposition of waste materials in this phase covers different thermal transformations such as structural changes and decomposition, cracking, condensation, and polymerization of the molecules.

Another advantageous method is to use the indirectly heated reactor as a dryer or desorber for the treatment of high moisture content nuclear contaminated sludges between the temperature range of 100° to 300° C. The radioactive contaminants that are concentrated in the powdered end product are mixed with warm bitumen or cement to form a water insoluble stabilized end product for long term disposal. It is advantageous to link an indirectly heated dryer reactor to the indirectly heated dry distillation reactor to increase the energy efficiency and capacity. The reactor can be used in single mode or in a linkage combination of reactors.

In FIGS. 2 to 5, various views of a specific embodiment of the dry distillation reactor of the apparatus are shown. The reactor (4) is rotating, permanently fed, closed, and horizontally arranged. The reactor includes cylinders (401) and hollow axes (403) at the end of the cylinder (401). Axes (403) are supported by ball bearings (402). One of the axes (403) is led into the loading house (404) while the other axes (403) is led into the unloading house (405). Axes (403) are separated with sealing (406) from loading house (404) and unloading house (405). Loading house (404) is provided with an opening (407) and a gas exit branch (409). Into the hollow of axes (403) at the side of loading house (404), there is a built-in loading pulley (410). Unloading paddles (411) are fixed to the inner case of cylinder (401) at the side of unloading house (405).

Figure 5:
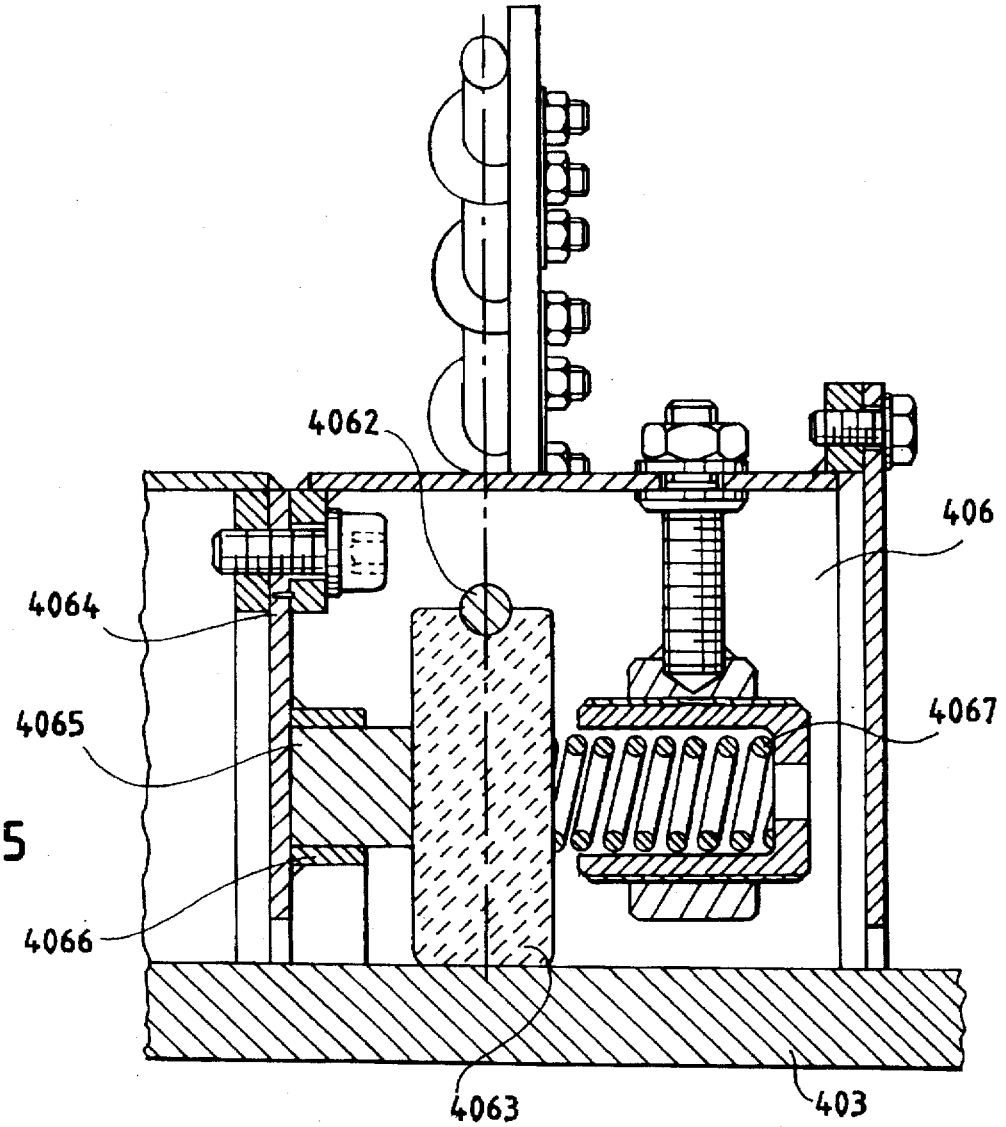
FIG. 5 is a section view of the sealings of the dry distillation reactor of the apparatus.

In FIG. 5, a section view of the sealing apparatus (406) is shown. The seal is made when sealing segments (4063) are drawn together by cord (4062), which is pulled by weights (4061). Sealing rings (4065) are placed between the sealing segments (4063) and the walls (4064) of the unloading house (405) and loading house (404). The sealing rings (4065) are secured against radial displacement along wall (4064) by holders (4066). The sealing segments (4063) and the sealing rings (4065) are secured against axial displacement by a spring clamp unit (4067).

I claim:

1. A reactor for the treatment of waste materials comprising:

a rotary, closed horizontally arranged cylinder, said cylinder having a first and a second end;

a pair of hollow axes, the first axes being placed on the first end of said cylinder and the second axes being placed on the second end of said cylinder;

two bearing means for supporting the first and second axes and for providing rotating movement;

an input house for introducing materials connected to the outer end of the first axes;

an output house connected to the outer end of the second axes;

a pair of sealing means, the first sealing means being placed on the first axes between the input house and the first end of the cylinder and the second sealing means being placed on the second axes between the output house and the second end of the cylinder; and an input pulley built-in into the hollow of the sideways axis of the input house, wherein said input house has a loading opening and a gas exit branch, said output house has an unloading opening and a gas exit branch, and said cylinder is provided with carrying-out shovels fixed to the interior surface of the cylinder at the side of the output house.

2. A reactor according to claim 1 wherein said sealing means comprises:

a plurality of sealing segments arranged circumferentially on the first and second axes;

a pair of sealing rings, the first sealing ring being placed between said sealing segments and the wall of the input house nearest the cylinder and the second sealing ring being placed between said sealing segments and the wall of the output house nearest the cylinder;

a cord for drawing together said sealing segments;

weights for pulling said cord;

holders fixed to the walls of the input and output house nearest the cylinder for securing the sealing rings against radial displacement; and a clamping means for securing said sealing segments and said sealing rings against axial displacement.

3. A reactor according to claim 1 wherein the waste materials are nuclear contaminated materials.

* * * * *